US010919300B2

(12) United States Patent
Fukunaga

(10) Patent No.: US 10,919,300 B2
(45) Date of Patent: Feb. 16, 2021

(54) CAP UNIT FOR RECORDING HEAD AND INKJET RECORDING APPARATUS INCLUDING THE SAME

(71) Applicant: KYOCERA Document Solutions Inc., Osaka (JP)

(72) Inventor: Yasuyuki Fukunaga, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/592,302

(22) Filed: Oct. 3, 2019

(65) Prior Publication Data

US 2020/0122467 A1 Apr. 23, 2020

(30) Foreign Application Priority Data

Oct. 19, 2018 (JP) ..... JP2018-197560

(51) Int. Cl.
*B41J 2/165* (2006.01)

(52) U.S. Cl.
CPC ..... *B41J 2/16511* (2013.01); *B41J 2/16547* (2013.01); *B41J 2/16585* (2013.01); *B41J 2002/16591* (2013.01)

(58) Field of Classification Search
CPC ..... B41J 2/16585
See application file for complete search history.

(56) References Cited

U.S. PATENT DOCUMENTS

2004/0113971 A1* 6/2004 Nakajima ..... B41J 11/002 347/29
2008/0309702 A1* 12/2008 Takahashi ..... B41J 2/16585 347/19
2009/0015627 A1* 1/2009 Takahashi ..... B41J 2/16585 347/32
2014/0210903 A1 7/2014 Tanda ..... 347/29
2014/0247303 A1* 9/2014 Ogawa ..... B41J 2/16532 347/30
2017/0129244 A1* 5/2017 Kurogochi ..... B41J 2/16508
2017/0305160 A1 10/2017 Kurogochi et al.

FOREIGN PATENT DOCUMENTS

CN 107031186 A 8/2017
JP 20141445 8/2014

OTHER PUBLICATIONS

Chinese Office Action dated Sep. 16, 2020, issued to corresponding Chinese Application No. 201910954878.1.

* cited by examiner

*Primary Examiner* — Julian D Huffman
(74) *Attorney, Agent, or Firm* — Stein IP, LLC

(57) ABSTRACT

A cap unit includes a cap portion which intimately contacts an ink ejection surface of a recording head of an inkjet recording apparatus, a support plate, a unit frame, and a plate moving mechanism. The support plate has the cap portion fixed thereto, and is supported to be movable in an up-down direction with respect to the unit frame. The unit frame supports the support plate, and has a fixing mechanism with respect to the inkjet recording apparatus. The plate moving mechanism is capable of moving the support plate, with the unit frame fixed to the inkjet recording apparatus, to a first position at which the cap portion is in contact with the ink ejection surface, and to a second position at which the cap portion is apart from the ink ejection surface.

10 Claims, 15 Drawing Sheets

CAP UNIT FOR RECORDING HEAD AND INKJET RECORDING APPARATUS INCLUDING THE SAME

INCORPORATION BY REFERENCE

This application is based upon and claims the benefit of priority from the corresponding Japanese Patent Application No. 2018-197560 filed on Oct. 19, 2018, the entire contents of which are incorporated herein by reference.

BACKGROUND

The present disclosure relates to a cap unit which is attached to an inkjet recording apparatus which performs recording by ejecting ink onto a recording medium, and which protects an ink ejection surface of a recording head, and in particular, the present disclosure relates to a cap unit that is attached to an inkjet recording apparatus when the inkjet recording apparatus is transported.

Inkjet recording apparatuses which form an image by ejecting ink onto a recording medium, such as a paper sheet, an OHP sheet, or the like, are capable of forming a high-definition image and thus have been widely used as recording apparatuses such as facsimile machines, copiers, and printers.

In such inkjet recording apparatuses, evaporation of ink solvent in an ink ejection nozzle provided in a recording head increases the concentration of the ink, which sometimes causes clogging of an ink ejection port at a leading end of the ink ejection nozzle. To prevent such clogging, inkjet recording apparatuses are provided with a cap for capping the ink ejection port.

For example, in a widely used configuration, an annular rib projecting from a peripheral portion of a cap main body made of rubber is pressed against an ink ejection surface of a recording head to thereby prevent drying of an ink ejection port located inside the annular rib.

SUMMARY

According to an aspect of the present disclosure, a cap unit includes a cap portion, a support plate, a unit frame, and a plate moving mechanism. The cap portion intimately contacts an ink ejection surface of a recording head of an inkjet recording apparatus and protects the ink ejection surface. The support plate has the cap portion fixed thereto, and is supported to be movable in an up-down direction with respect to the unit frame. The unit frame supports the support plate, and has a fixing mechanism with respect to an inkjet recording apparatus. The plate moving mechanism is capable of moving the support plate, with the unit frame fixed to the inkjet recording apparatus, to a first position at which the cap portion is in contact with the ink ejection surface, and to a second position at which the cap portion is apart from the ink ejection surface.

Still other objects of the present disclosure and specific advantages provided by the present disclosure will become further apparent from the following descriptions of embodiments.

22 such that the support plate is fixed and the cap portion is in intimate contact with the ink ejection surface.

DETAILED DESCRIPTION

Figure 1:
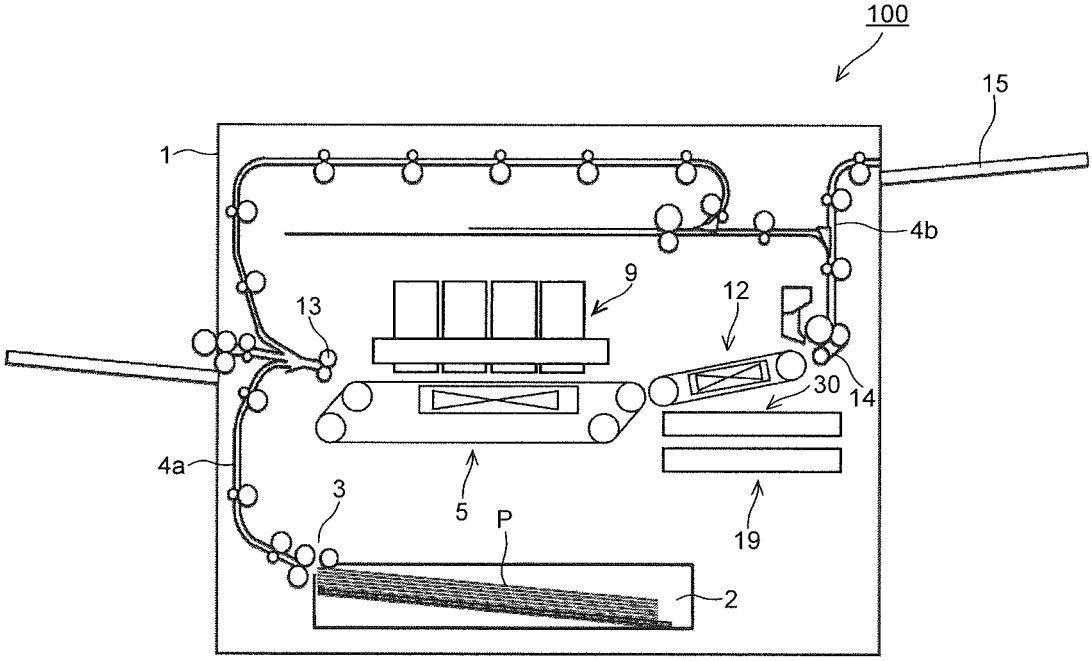
FIG. 1 is a diagram showing a structure of an inkjet printer to which a transport cap unit according to the present disclosure is attached.

With reference to FIG. 1 to FIG. 25, a description will be given of an inkjet printer 100 (which is an inkjet recording apparatus, and will hereinafter be referred to as the printer 100) and a transport cap unit 50 according to the present disclosure, which is attached to the printer 100. As shown in FIG. 1, the printer 100 has a sheet feeding cassette 2 which is a sheet storage portion and disposed in a lower portion inside a printer main body 1. The sheet feeding cassette 2 holds therein paper sheets P as an example of a recording medium. On a downstream side of the sheet feeding cassette 2 in a sheet conveyance direction, in other words, on the upper-left side of the sheet feeding cassette 2 in FIG. 1, a sheet feeding device 3 is disposed. By the sheet feeding device 3, the paper sheets P are fed out one by one separately toward the upper-left side of the sheet feeding cassette 2 in FIG. 1.

The printer 100 further includes a first sheet conveyance path 4*a* arranged inside thereof. The first sheet conveyance path 4*a* is located, with respect to the sheet feeding cassette 2, on the upper-left side, toward which a paper sheet is fed out from the sheet feeding cassette 2. The paper sheet P fed out from the sheet feeding cassette 2 is conveyed vertically upward along a side surface of the printer main body 1 via the first sheet conveyance path 4*a*.

At a downstream end of the first sheet conveyance path 4*a* with respect to the sheet conveyance direction, a registration roller pair 13 is provided. Furthermore, a first belt conveyance portion 5 and a recording portion 9 are arranged immediately close to the registration roller pair 13 on a downstream side of the registration roller pair 13 in the sheet conveyance direction. The paper sheet P fed out from the sheet feeding cassette 2 passes through the first sheet conveyance path 4*a* and reaches the registration roller pair 13. The registration roller pair 13 on one hand temporarily stops the paper sheet P to correct skewed feeding of the paper sheet P, and on the other hand restarts conveying the paper sheet P toward the first belt conveyance portion 5 with timing coordinated with an ink ejection operation performed by the recording portion 9.

On a downstream side (right side in FIG. 1) of the first belt conveyance portion 5 with respect to the sheet conveyance direction, a second belt conveyance portion 12 is arranged. The paper sheet P having an ink image formed thereon at the recording portion 9 is sent to the second belt conveyance portion 12, and while the paper sheet P passes through the second belt conveyance portion 12, the ink having been ejected onto a surface of the paper sheet P is dried.

On a downstream side of the second belt conveyance portion 12 with respect to the sheet conveyance direction, near a right side face of the printer main body 1, a decurler portion 14 is provided. The paper sheet P having had the ink dried at the second belt conveyance portion 12 is sent to the decurler portion 14, where curl in the paper sheet P is corrected by using a plurality of rollers arranged in a sheet width direction.

On the downstream side of (in FIG. 1, above) the decurler portion 14 in the sheet conveyance direction, a second sheet conveyance path 4*b* is provided. The paper sheet P having passed through the decurler portion 14 is, unless double-side recording is requested, conveyed through the second sheet conveyance path 4*b* and is discharged via a discharge roller pair onto a sheet discharge tray 15 provided on an outer right-side face of the printer 100.

Further, a maintenance unit 19 and a cap unit 30 are arranged below the second belt conveyance portion 12. When a later-described purge is performed, the maintenance unit 19 horizontally moves to below the recording portion 9 to wipe away ink having been pushed out from ink ejection nozzles 18 of recording heads 17*a* to 7*c*, which will be described later, and collects the ink having been wiped away. At a time of capping an ink ejection surface F (see FIG. 4) of each of the recording heads 17*a* to 17*c*, the cap unit 30 horizontally moves to below the recording portion 9, and further moves upward and to bee attached to lower surfaces of the recording heads 17*a* to 17*c*.

Figure 2:
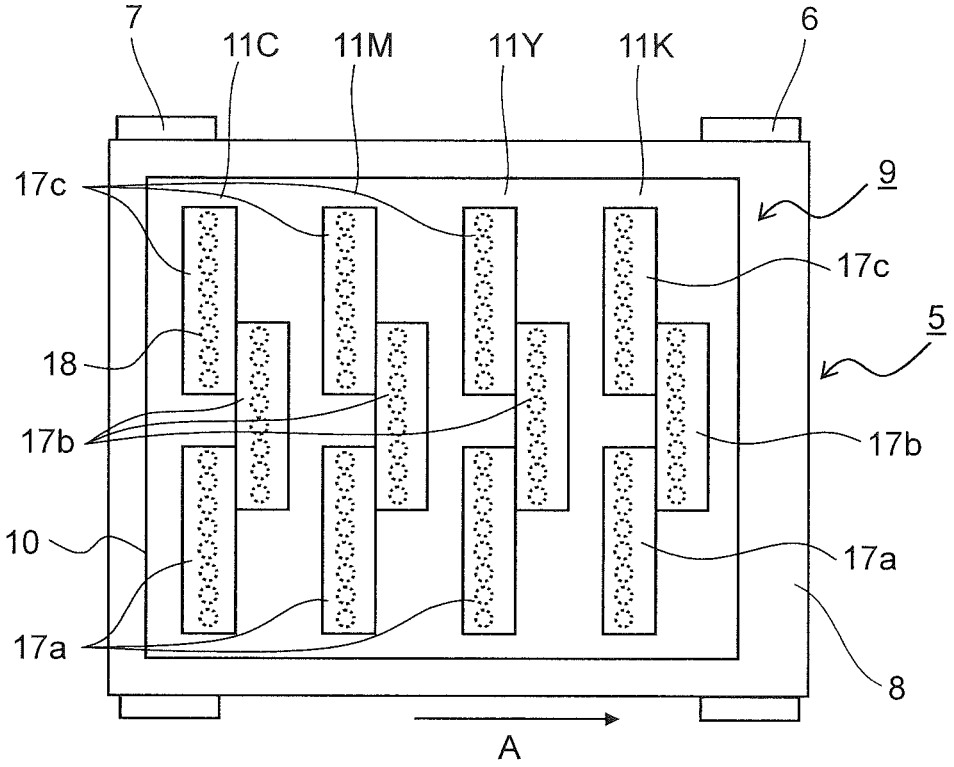
FIG. 2 is a diagram showing a first belt conveyance portion and a recording portion of the printer as viewed from above.
Figure 3:
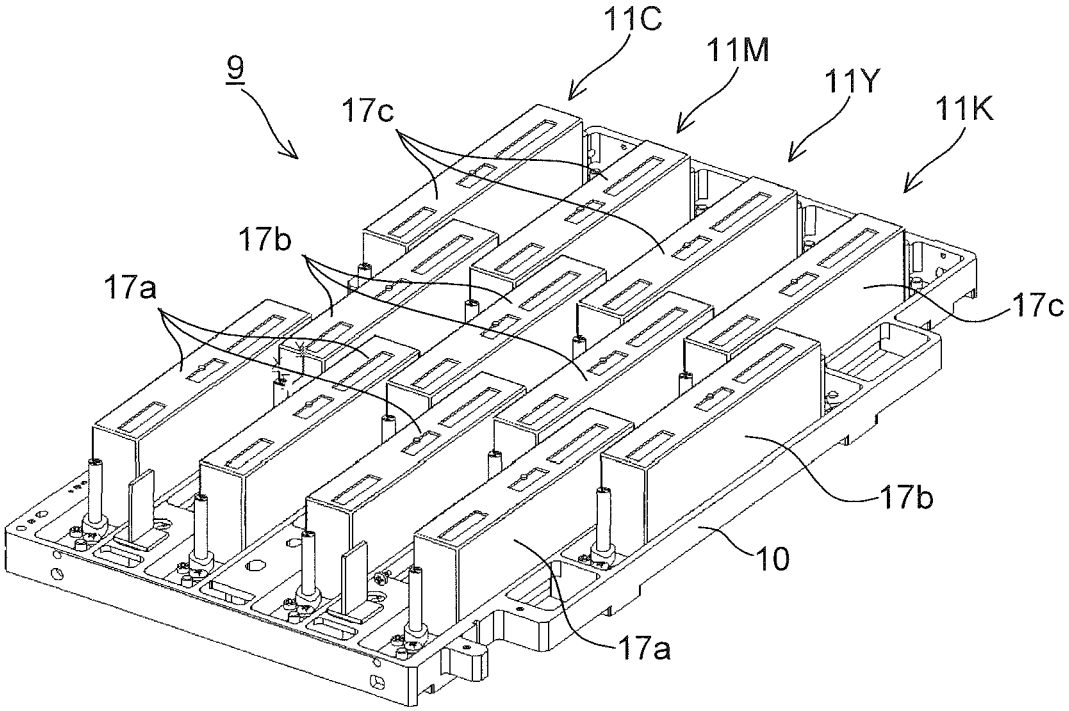
FIG. 3 is a diagram showing a structure of the recording portion of the printer.

As shown in FIG. 2 and FIG. 3, the recording portion 9 is provided with a head housing 10 and line heads 110, 11M, 11Y, and 11K held in the head housing 10. The line heads 11C to 11K are supported at a height such that a predetermined gap (for example, 1 mm) is formed between each of the line heads 11C to 11K and a conveyance surface of a first conveyance belt 8 that is wound around and between a plurality of rollers including a driving roller 6 and a driven roller 7; each of the line heads 11C to 11K is formed by arranging a plurality of (herein, three) recording heads 17*a* to 17*c* in a staggered manner along the sheet width direction (an up-down direction in FIG. 2), which is orthogonal to the sheet conveyance direction (an arrow-A direction). The line heads 110 to 11K each have a recording region having a width that is equal to or larger than that of the paper sheet P conveyed, and each eject water-based ink (hereinafter, simply referred to as "ink") toward the paper sheet P conveyed by the first conveyance belt 8 from an ink ejection nozzle 18 corresponding to a printing position.

Figure 4:
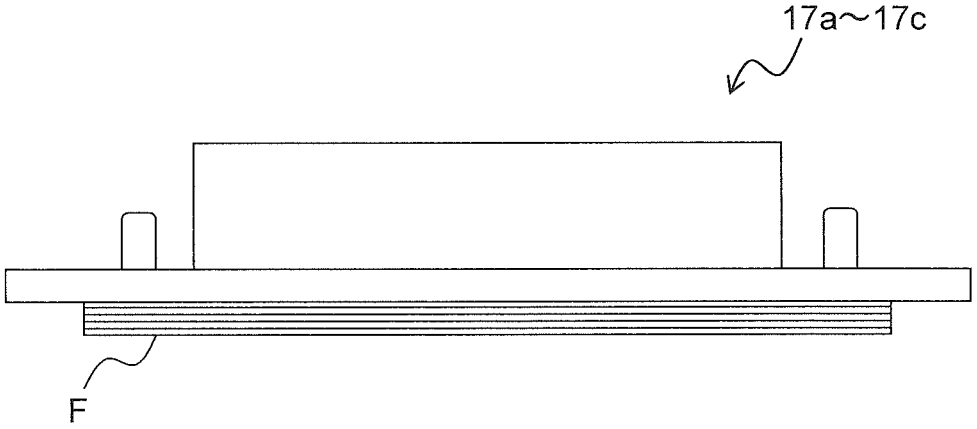
FIG. 4 is a diagram showing a structure of a recording head constituting a line head of the recording portion of the printer.
Figure 5:
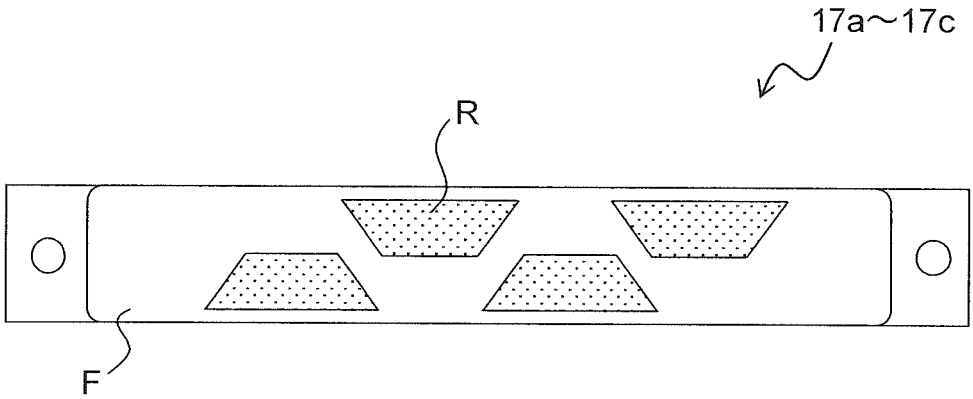
FIG. 5 is a diagram showing the recording head of the printer as viewed from a side where an ink ejection surface is located.

As shown in FIG. 5, on the ink ejection surface F of each of the recording heads 17*a* to 17*c*, nozzle regions R are provided where a large number of ink ejection nozzles 18 are arranged. Further, the ink ejection surface F has formed thereon a water-repellent film (not shown). Here, since the recording heads 17*a* to 17*c* are the same in shape and configuration, FIG. 4 and FIG. 5 show one recording head representing the recording heads 17*a* to 17*c*.

The recording heads 17*a* to 17*c* constituting each of the line heads 110 to 11K are supplied with ink of one of four colors (cyan, magenta, yellow, and black) stored in ink tanks (not shown), respectively, which corresponds to a color of each of the line heads 110 to 11K.

In accordance with image data received from an external computer or the like, the recording heads 17*a* to 17*c* eject ink from the ink ejection nozzles 18 toward the paper sheet P conveyed by being attracted onto a conveyance surface of the first conveyance belt 8. Thereby, on the paper sheet P held on the first conveyance belt 8, ink images of the four colors of cyan, magenta, yellow, and black are superimposed on each other to form a color image.

Further, to prevent defective ejection of ink due to drying up or clogging of the recording heads 17*a* to 17*c*, a purge is performed in preparation for a subsequent printing operation in the following fashion. When printing is started after a long period of non-operation state, ink with increased viscosity is expelled from the ink ejection nozzles 18 of all the recording heads 17*a* to 17*c*, or, during intermissions in printing, ink with increased viscosity is expelled from such one or ones of the ink ejection nozzles 18 of the recording heads 17*a* to 17*c* as have ejected less than a reference amount of ink.

Figure 6:
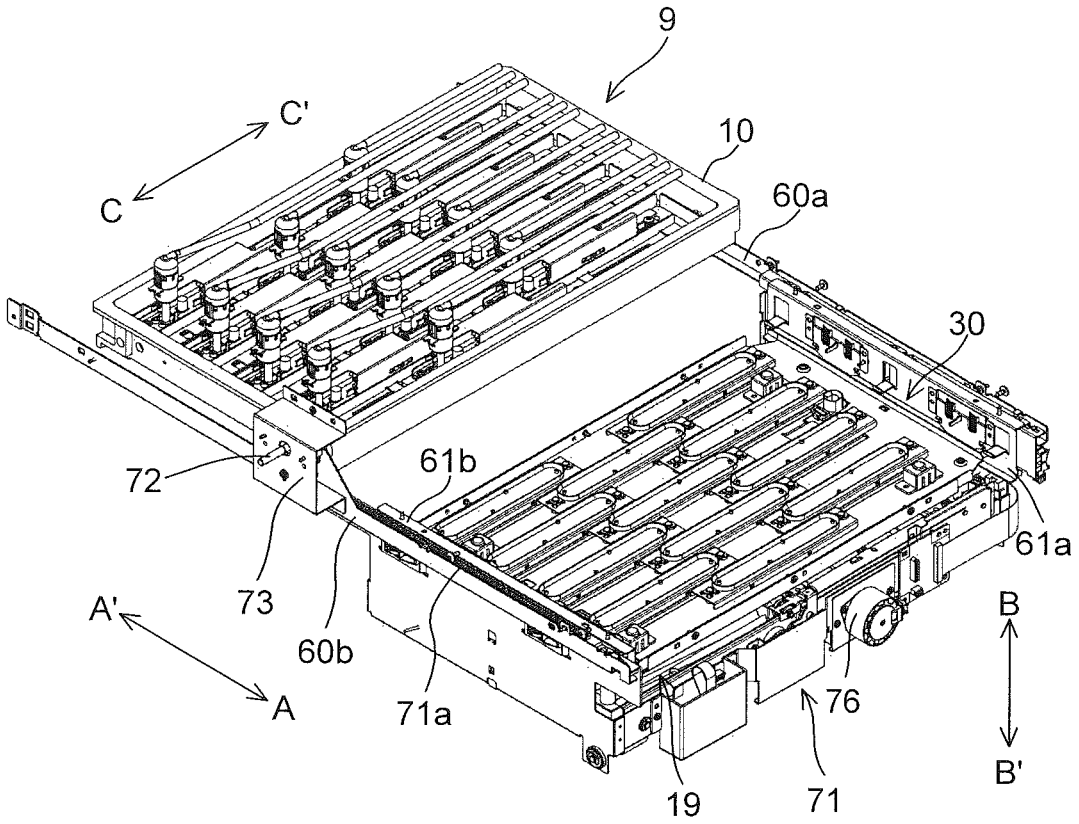
FIG. 6 is a diagram showing a structure of the recording portion, a cap unit, a maintenance unit, etc., of the printer.

As shown in FIG. 6, below the recording portion 9, two guide rails 60*a* and 60*b* are fixed along two opposite end portions thereof parallel to the sheet conveyance direction (the arrow-A direction). To the guide rails 60*a* and 60*b*, there are fixed a pair of guide plates 61*a* and 61*b*, respectively, and on lower end portions of the guide plates 61*a* and 61*b*, side end edges of the cap unit 30 are supported. Further, a carriage 71 is slidably supported on the guide rails 60*a* and 60*b*, and the maintenance unit 19 is placed on the carriage 71.

The cap unit 30 is capable of reciprocating between a first position (position in FIG. 18) directly under the recording portion 9 and a second position (position in FIG. 6) retracted from the first position in a horizontal direction (the arrow-A direction), and is configured to move upward at the first position to cap the recording heads 17*a* to 17*c*.

Figure 7:
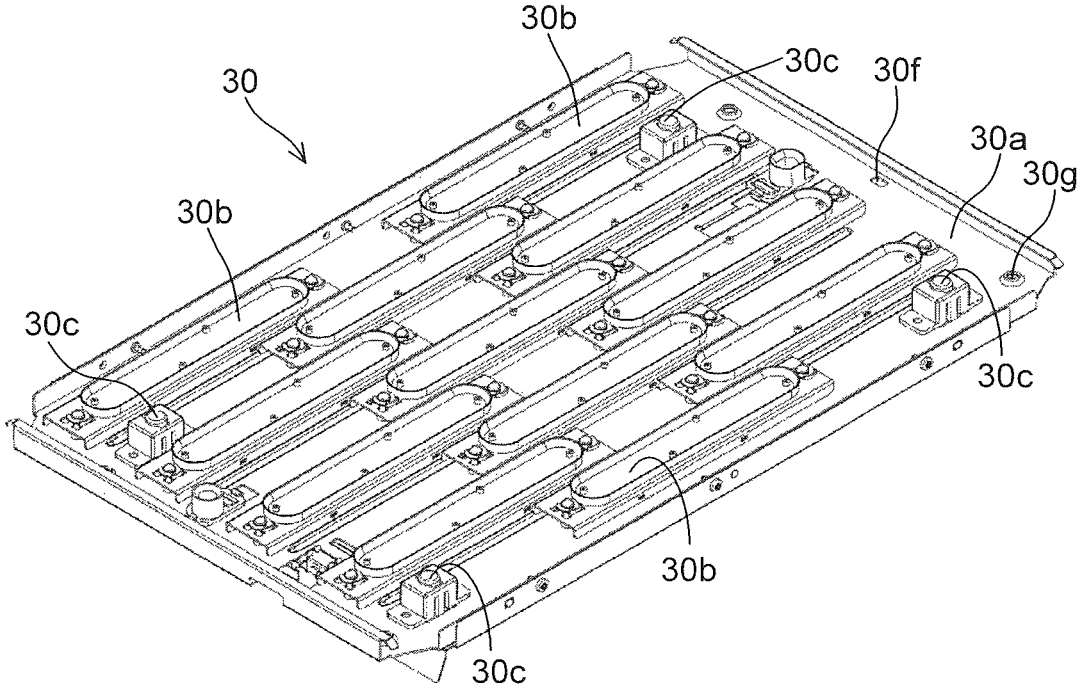
FIG. 7 is a diagram showing a structure of the cap unit of the printer.

Specifically, as shown in FIG. 7, the cap unit 30 includes a cap tray 30*a* made of a metal sheet, twelve cap portions 30*b* which are recess-shaped and arranged on an upper surface of the cap tray 30*a*, and four height-direction positioning protrusions 30*c*.

The cap portions 30*b* are arranged at positions corresponding to the recording heads 17*a* to 17*c*. With this arrangement, as a result of upward movement of the cap unit 30 located at the first position, the cap portions 30*b* cap the ink ejection surfaces F of the recording heads 17*a* to 17*c*. The height-direction positioning protrusions 30*c* come into contact with the head housing 10 of the recording portion 9 when the cap unit 30 is raised toward the recording portion 9 to cap the recording heads 17*a* to 17*c*, and thereby a constant contact state is maintained between the cap portions 30*b* and the ink ejection surfaces F.

The maintenance unit 19 is capable of reciprocating between a first position (the position in FIG. 15) which is directly under the recording portion 9 and a second position (the position in FIG. 6) retracted from the first position in the horizontal direction (the arrow-A direction), and the maintenance unit 19 is configured to move upward at the first position to perform a wiping operation, which will be described later.

Specifically, to an external side of the guide rail 60*b*, there are attached a drive motor 72 for moving the carriage 71 in an arrow-AA' direction, a gear train (not shown) which engages with the drive motor 72 and with rack teeth 71*a* of the carriage 71, and a cover member 73 which covers these. Forward rotation of the drive motor 72 makes the gear train rotate to make the carriage 71 and the maintenance unit 19 move from the second position to the first position. Here, the drive motor 72, the gear train, and other components constitute a unit moving mechanism that makes the maintenance unit 19 move in the horizontal direction.

Figure 8:
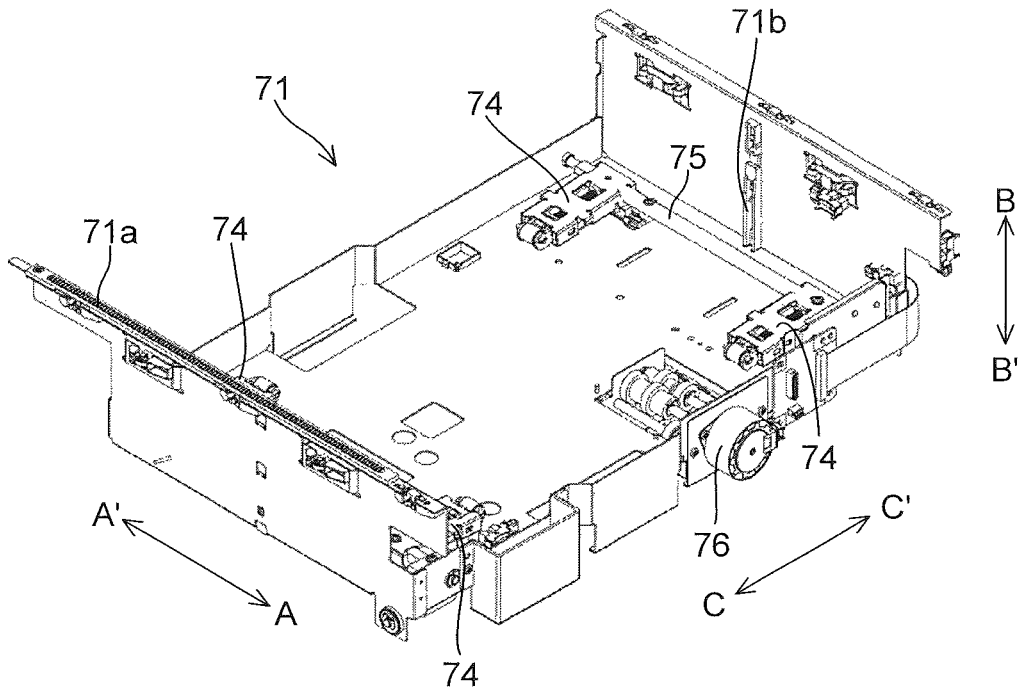
FIG. 8 is a perspective view showing a structure of a carriage of the printer, with a support arm laid down.
Figure 9:
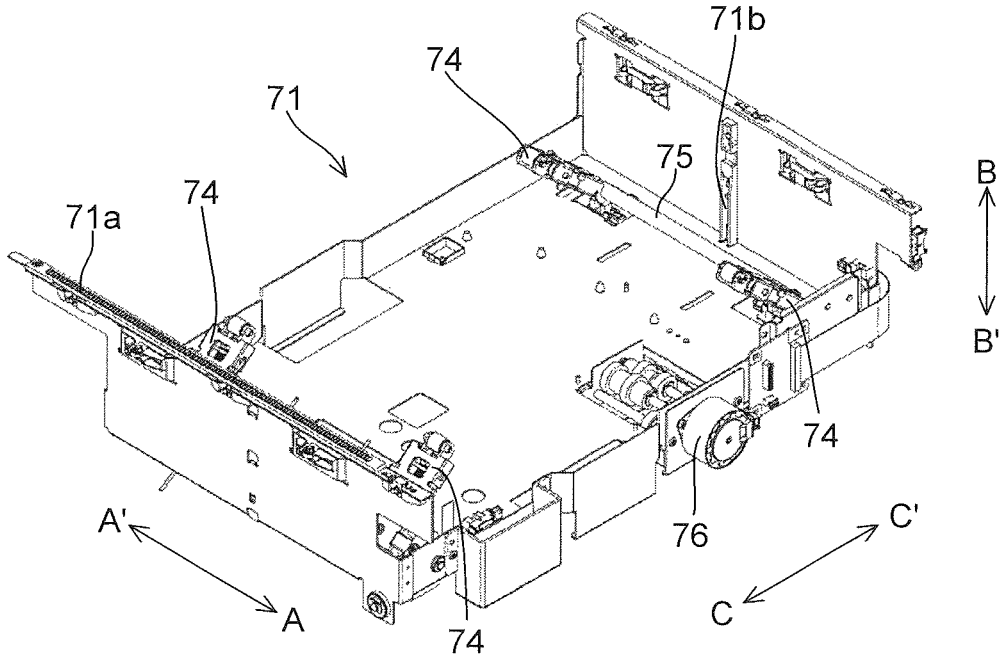
FIG. 9 is a perspective view showing the structure of the carriage of the printer, with the support arm standing.

Furthermore, in four corners of the carriage 71, as shown in FIG. 8 and FIG. 9, there are provided support arms 74 which support the maintenance unit 19 from its lower surface side, and which also are swingable (between a standing position and a laid-down position). Two adjacent ones of the support arms 74 in the arrow-AA' direction are coupled to each other by a rotation shaft 75. Further, to an external side of the carriage 71, there are attached a wipe lift motor 76 for swinging the support arms 74, a gear train or the like (not shown) that engages with the wipe lift motor 76 and with a gear of the rotation shaft 75. Forward rotation of the drive motor 76 makes the gear train or the like rotate to make the rotation shaft 75 rotate, and thereby the support arms 74 are made to swing (stand up). This makes the maintenance unit 19 move upward. Here, the wipe lift motor 76, the gear train, the rotation shafts 75, the support arms 74, etc. constitute a unit lift mechanism that makes the maintenance unit 19 move in the up-down direction (an arrow-BB' direction). On an internal surface of the carriage 71, there is formed a guide groove 71*b* which extends in the up-down direction, and the maintenance unit 19 moves up and down along the guide groove 71*b*.

Figure 10:
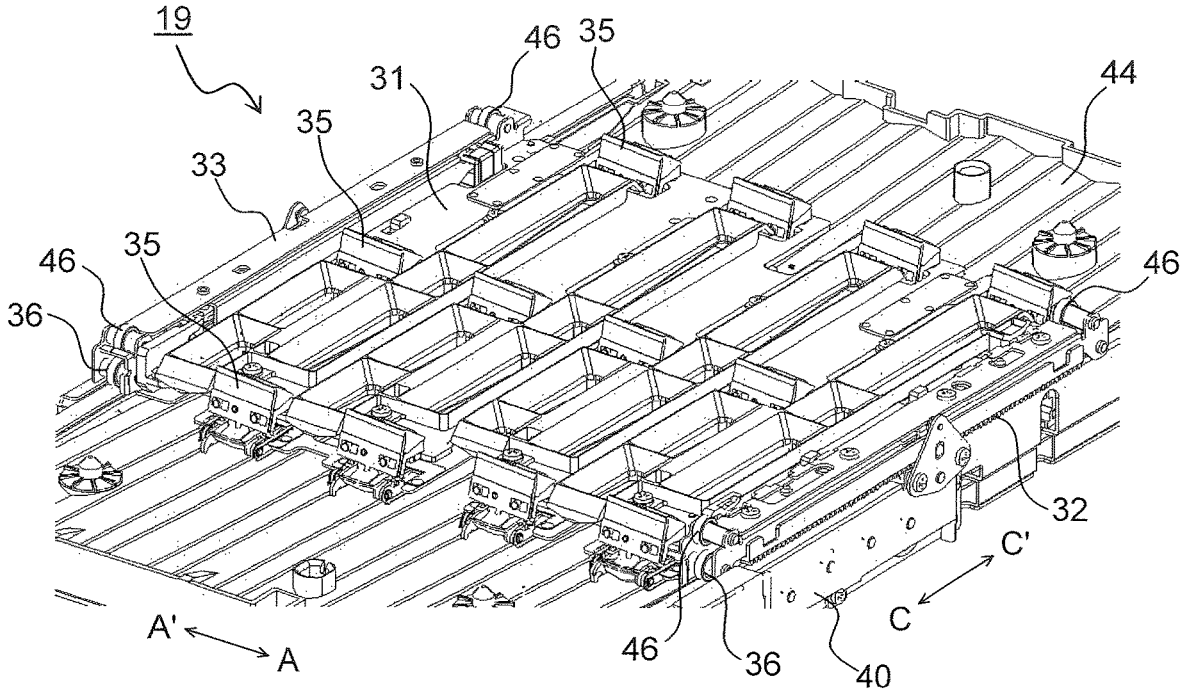
FIG. 10 is an enlarged view of a maintenance unit incorporated in the printer.
Figure 11:
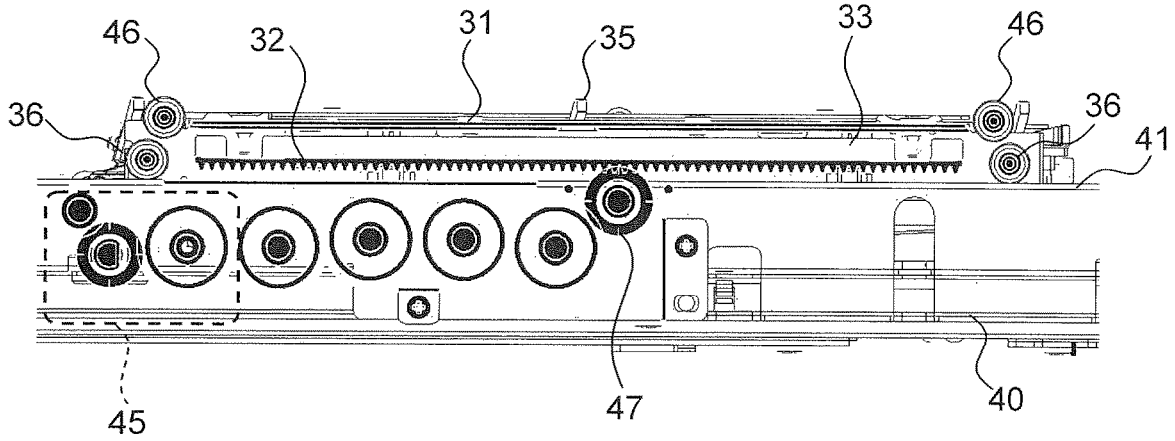
FIG. 11 is a sectional view showing a structure of a drive portion of the maintenance unit.
Figure 12:
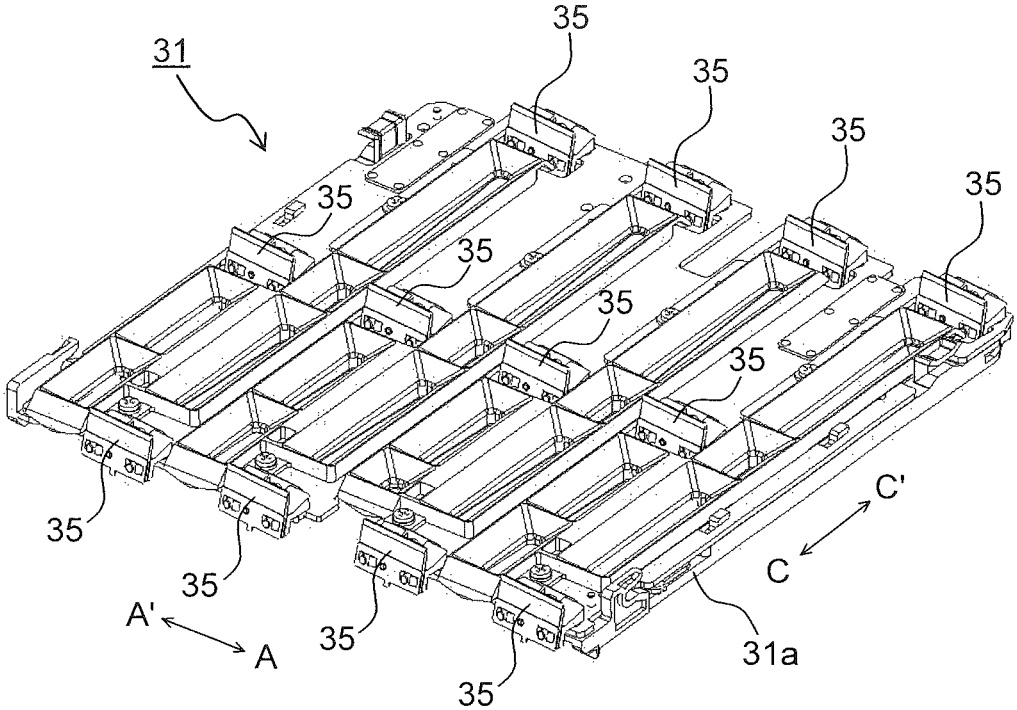
FIG. 12 is a perspective view of a blade unit constituting the maintenance unit.
Figure 13:
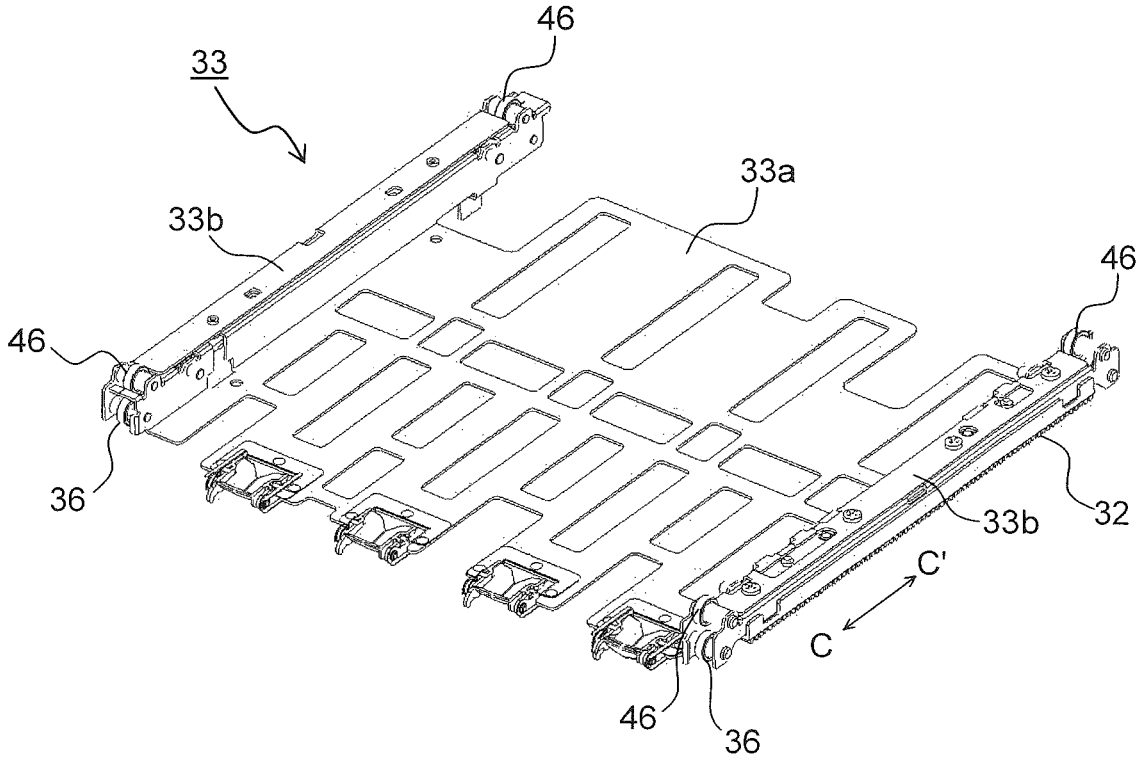
FIG. 13 is a perspective view of a wiper carriage constituting the maintenance unit.

FIG. 10 is an enlarged view of the maintenance unit 19 incorporated in the printer 100 as viewed from above. FIG. 11 is a sectional view showing a structure of a drive portion of the maintenance unit 19. FIG. 12 and FIG. 13 are perspective views of a blade unit 31 and a wiper carriage 33, respectively, which constitute the maintenance unit 19. The maintenance unit 19 is constituted by the blade unit 31 to which a plurality of wipers (wiper blades) 35 are fixed, the wiper carriage 33 which is rectangular in shape and to which the blade unit 31 is attached, and a support frame 40 which supports the wiper carriage 33.

As shown in FIG. 10 and FIG. 11, the support frame 40 has a rail groove 41 formed in each of opposite end edges of its upper surface, and a sliding pulley 36 provided at each of four positions in the wiper carriage 33 contacts the rail groove 41, whereby the wiper carriage 33 is supported to be slidable in an arrow-CC' direction with respect to the support frame 40.

To the support frame 40, there are attached a wiper drive motor 45 for making the wiper carriage 33 move in the horizontal direction (the arrow-CC' direction) and a rack drive gear 47 which engages with a rack 32 of the wiper carriage 33. Forward or reverse rotation of the wiper drive motor 45 makes, via the gear train, the rack drive gear 47 rotate forward or reversely to make the wiper carriage 33 reciprocate in the horizontal direction (the arrow-CC' direction). Here, the wiper drive motor 45, the rack drive gear 47, etc., constitute a wiper moving mechanism which makes the wipers 35 move along the ink ejection surfaces F of the recording heads 17*a* to 17*c*.

On the upper surface of the support frame 40, an ink collection tray 44 is arranged for collecting waste ink wiped away from the ink ejection surfaces F by the wipers 35. At a substantially central portion of the ink collection tray 44, an ink discharge hole (not shown) is formed, and tray surfaces on opposite sides with respect to the ink discharge hole are each inclined downward toward the ink discharge hole. Waste ink having been wiped away from the ink ejection surfaces F by the wipers 35 to fall onto the tray surfaces flows toward the ink discharge hole (not shown). Then, the waste ink flows through a waste ink collection passage (not shown) coupled to the ink discharge hole, to be collected in a waste ink collection tank (not shown).

The wipers 35 are each a rubber member made of EPDM, for example, for wiping away ink expelled from the ink ejection nozzles 18 of the recording heads 17*a* to 17*c*. The wipers 35 are substantially vertically pressed against wiping starting positions which are outside the nozzle regions R (see FIG. 5) where the ink ejection nozzles 18 are exposed, and the wiper carriage 33 moves in a predetermined direction (an arrow-C direction) to wipe the ink ejection surfaces F including the nozzle regions R.

As shown in FIG. 12, four wipers 35 are arranged substantially at regular intervals along a width direction of a unit main body 31*a* of the blade unit 31 (the arrow-AA' direction) in each of three rows along a moving direction (the arrow-CC' direction) of the wiper carriage 33, and thus a total of twelve wipers 35 are arranged. The wipers 35 are arranged at positions corresponding to the recording heads 17*a* to 17*c* (see FIG. 3) constituting the line heads 11C to 11K. The blade unit 31 is detachable and attachable with respect to the wiper carriage 33, and thus, the blade unit 31, together with the unit main body 31*a*, can be replaced when the wipers 35 are worn away or broken.

As shown in FIG. 13, the wiper carriage 33 includes a carriage main body 33*a* which is plate-shaped, and a rail portion 33*b* provided on each of side end portions of the carriage main body 33*a*. To the carriage main body 33*a*, the blade unit 31 is attached. The rail portion 33*b* is provided with the rack 32, the sliding pulley 36, and a positioning pulley 46. The rack 32 is provided along one end edge of the carriage main body 33*a*, and meshes with the rack drive gear 47 of the support frame 40. The sliding pulley 36 contacts the rail groove 41 formed in the support frame 40.

The positioning pulley 46 is provided at each of four positions on an upper surface of the carriage main body 33*a*. When the support frame 40 is raised toward the recording portion-9 side for performing the wiping operation with respect to the ink ejection surfaces F of the recording heads 17*a* to 17*c*, the positioning pulley 46 contacts the head housing 10 of the recording portion 9, and thereby a constant contact state is maintained between the wipers 35 and the ink ejection surfaces F.

Figure 14:
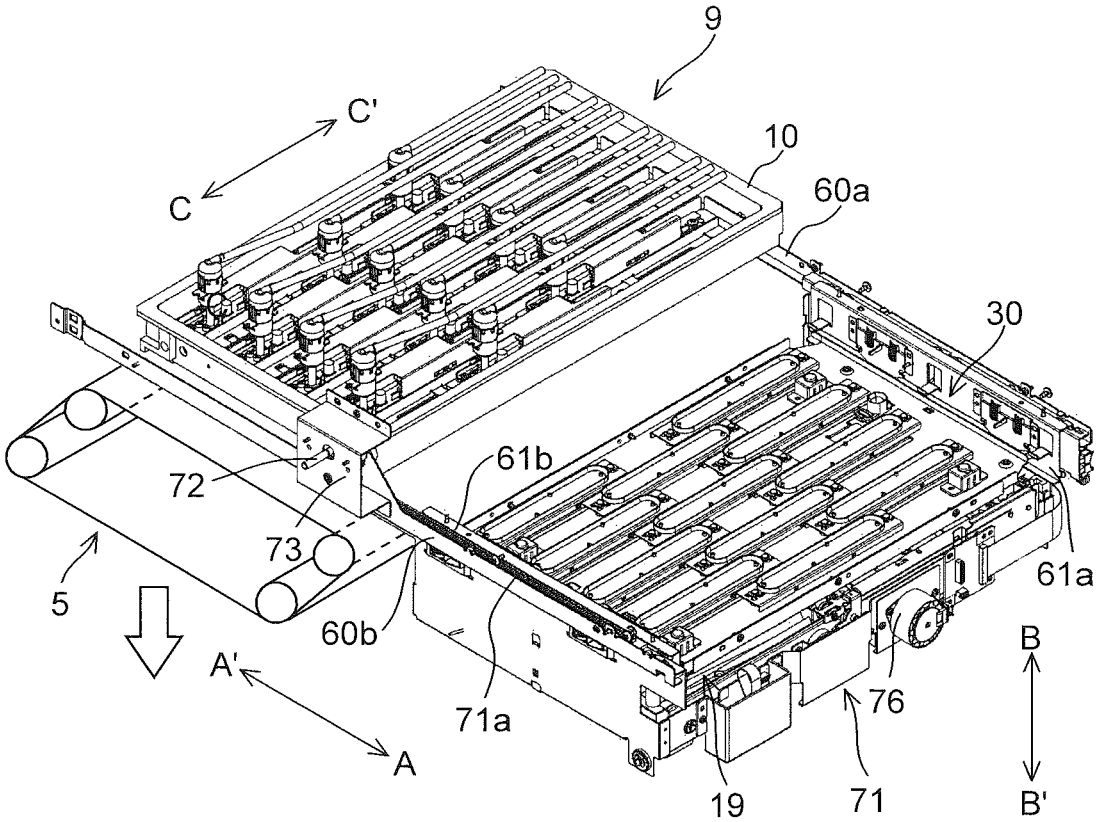
FIG. 14 is a diagram showing a state in which a first belt conveyance portion has been lowered.
Figure 15:
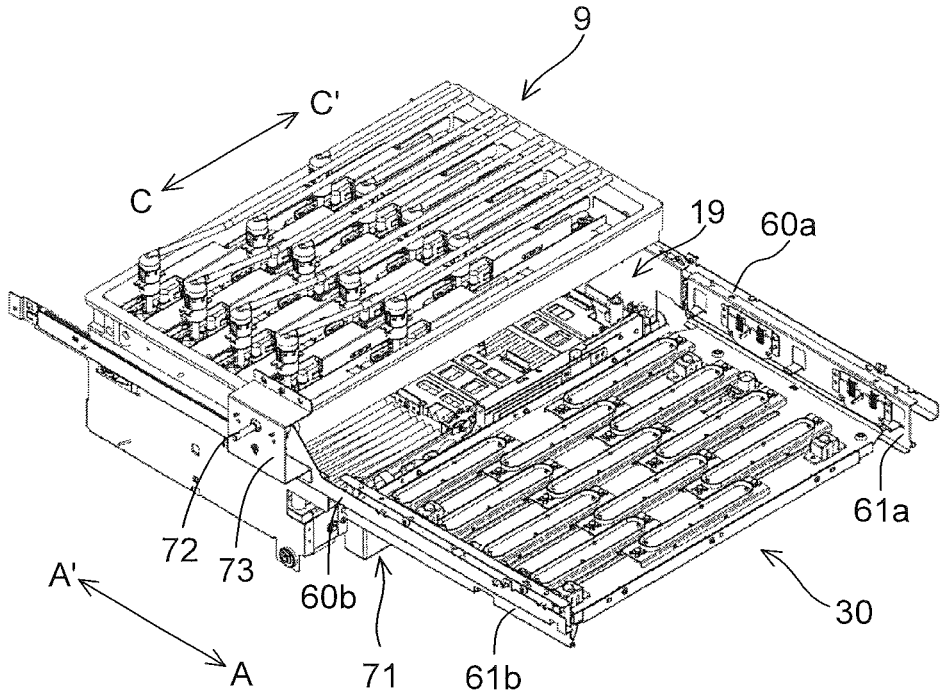
FIG. 15 is a diagram showing a state in which the maintenance unit of the printer has been moved to a first position.

Next, a description will be given of a recovery operation performed with respect to the recording heads 17*a* to 17*c* in the printer 100. When processing to recover the recording heads 17*a* to 17*c* is to be performed by the maintenance unit 19, as shown in FIG. 14, the first belt conveyance portion 5, which is disposed opposite a lower surface of the recording portion 9, is lowered. Then, as shown in FIG. 15, with the cap unit 30 left at the second position, the unit moving mechanism makes the maintenance unit 19 move from the second position to the first position.

Then, before the wiping operation is performed, ink 22 is supplied to the recording heads 17*a* to 17*c*. The thus supplied ink 22 is forcibly expelled (purged) from the ink ejection nozzles 18. By this purge operation, thickened ink, foreign matters, and bubbles are discharged from inside the ink ejection nozzles 18, whereby the recording heads 17*a* to 17*c* can be recovered.

Figure 16:
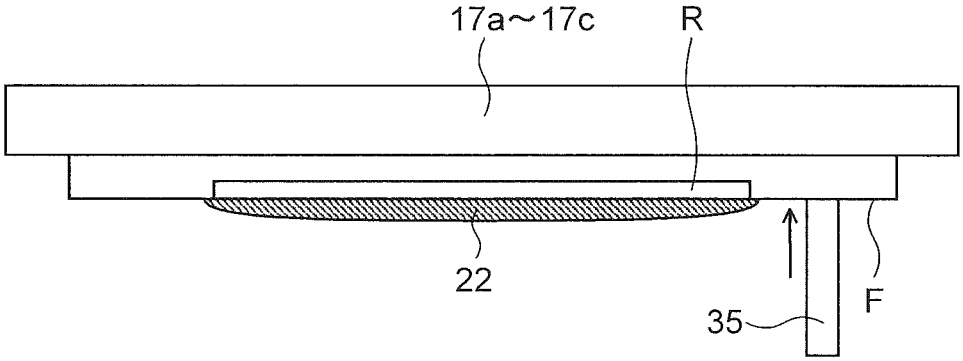
FIG. 16 is a diagram showing a state in which a wiper of the printer is pressed against a wiping starting position on an ink ejection surface of the recording head.

Next, the wiping operation is performed to wipe away the ink 22 having been discharged onto the ink ejection surfaces F. Specifically, as shown in FIG. 16, the maintenance unit 19 is raised by means of the unit lift mechanism so as to press the wipers 35 against the wiping starting positions on the ink ejection surfaces F of the recording heads 17*a* to 17*c*.

Figure 17:
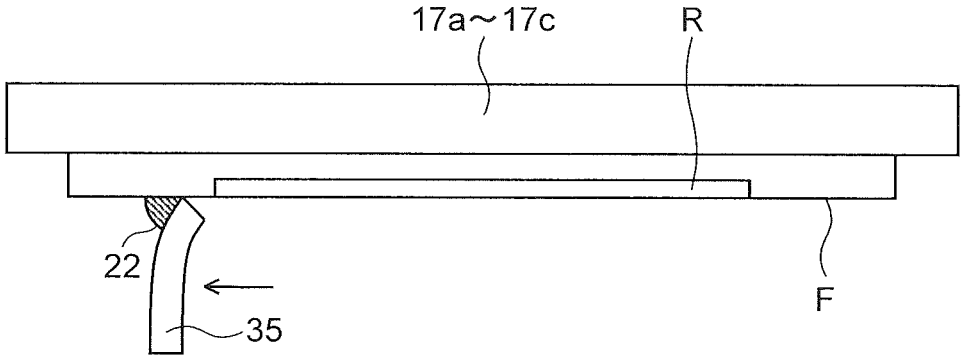
FIG. 17 is a diagram showing a state in which purged ink that has been pushed out onto the ink ejection surface of the recording head is being wiped away by means of the wiper of the printer.

Then, the wiper carriage 33 is horizontally moved in the arrow-C direction by means of the wiper drive motor 45 (see FIG. 11), whereby, as shown in FIG. 17, the wipers 35 wipe away the ink 22 having been expelled onto the ink ejection surfaces F of the recording heads 17*a* to 17*c*.

After the wipers 35 moves to downstream-side end portions of the ink ejection surfaces F of the recording heads 17*a* to 17*c*, the wiper carriage 33 is lowered by means of the unit lift mechanism. Thereby, the wipers 35 is retracted downward from the ink ejection surfaces F of the recording heads 17*a* to 17*c*.

Then, the maintenance unit 19 is moved in the arrow-A direction from the first position by means of the unit moving mechanism. Thereby, as shown in FIG. 14, the maintenance unit 19 is brought to a predetermined position (the second position) directly under the cap unit 30.

Next, a description will be given of an operation of attaching the cap unit 30 to the recording heads 17*a* to 17*c* in the printer 100 of the present embodiment. When capping is performed with respect to the recording heads 17*a* to 17*c* by means of the cap unit 30, as shown in FIG. 14, the first belt conveyance portion 5, which is arranged opposite the lower surface of the recording portion 9, is lowered.

Figure 18:
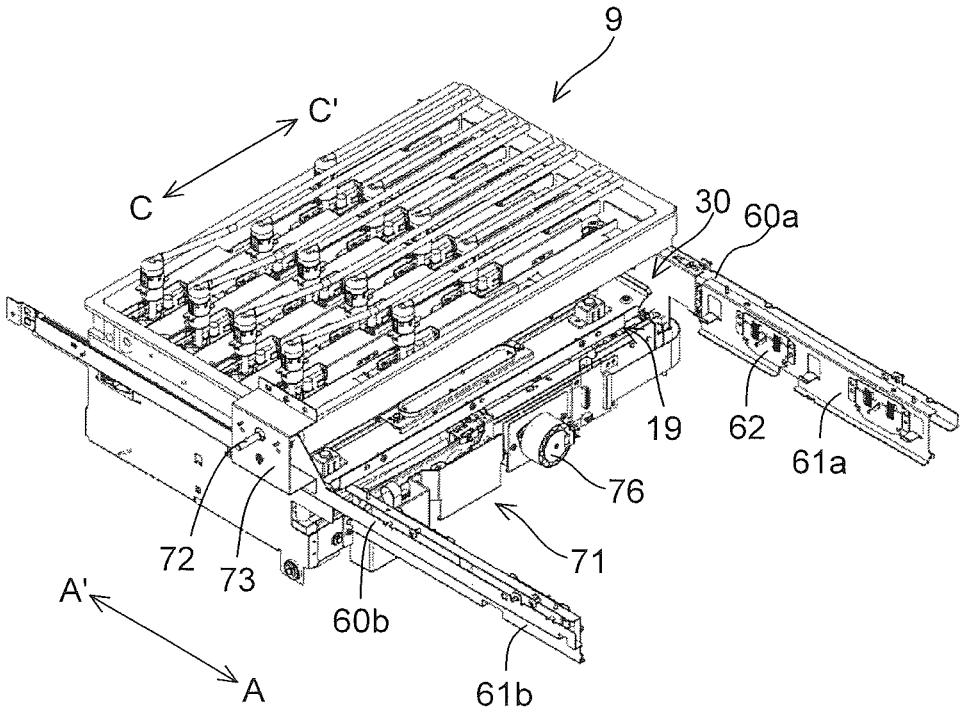
FIG. 18 is a diagram showing a state in which the cap unit and the maintenance unit of the printer have been moved to the first position.

Then, as shown in FIG. 18, with the cap unit 30 disposed on the maintenance unit 19, the maintenance unit 19 and the cap unit 30 are moved from the second position to the first position by means of the unit moving mechanism. Then, the maintenance unit 19 and the cap unit 30 are raised by means of the unit lift mechanism, whereby the cap unit 30 (the cap portions 30*b*) is attached to the recording heads 17*a* to 17*c*.

Figure 19:
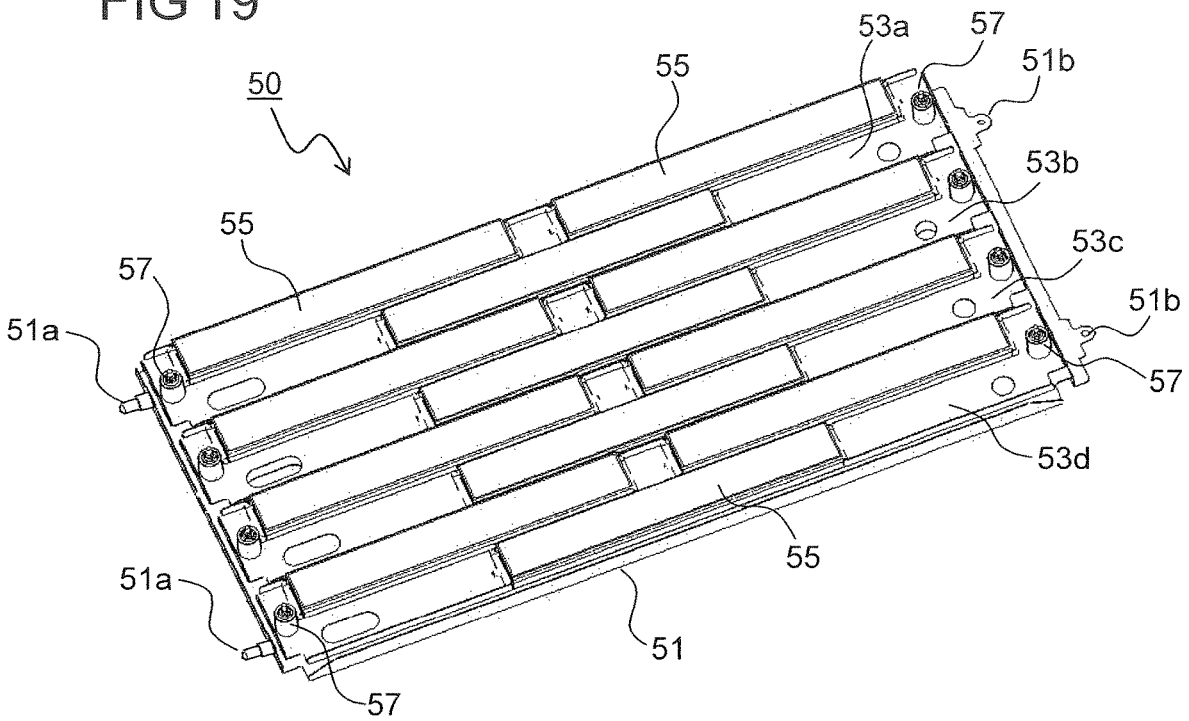
FIG. 19 is a perspective view of a transport cap unit according to an embodiment of the present disclosure attached to the printer, as viewed from a side where a surface facing the recording head is located.

FIG. 19 is a perspective view of the transport cap unit 50 according to an embodiment of the present disclosure attached to the printer 100, as viewed from a side where a surface opposite the recording heads 17*a* to 17*c* is located. The transport cap unit 50 includes a unit frame 51, support plates 53*a* to 53*d*, cap portions 55, and plate fixing screws 57.

The unit frame 51 is a rectangular, metal sheet member, and supports the four support plates 53*a* to 53*d* on its upper surface. Fixing pins 51*a* are provided one at each of two positions on a rear-side (in FIG. 19, left-side) end portion of the unit frame 51. Screw-fastening portions 51*b* are provided one at each of two positions on a front-side (in FIG. 19, right-side) end portion of the unit frame 51.

The support plates 53*a* to 53*d* are arranged parallel to each other in a width direction of the unit frame 51 (an up-down direction in FIG. 19), and each supported to be independently movable in the up-down direction with respect to the unit frame 51. The support plates 53*a* to 53*d* are arranged respectively corresponding to the line heads 110, 11M, 11Y, and 11K (see FIG. 3) of the recording portion 9. On upper surfaces of the support plates 53*a* to 53*d*, the cap portions 55, three corresponding to the three recording heads 17*a* to 17*c* of each of the line heads 110 to 11K, are arranged in a staggered fashion.

Figure 21:
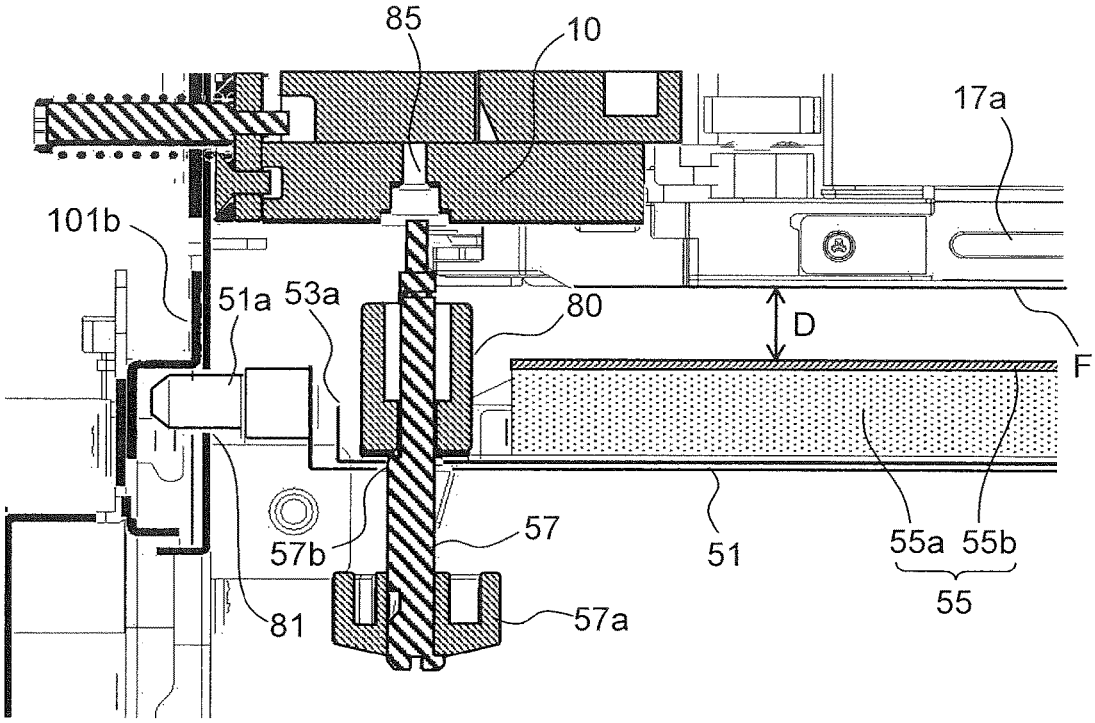
FIG. 21 is a partial sectional view of a rear side of the printer, with the transport cap unit according to the embodiment attached to the printer.

The cap portions 55 intimately contact the ink ejection surfaces F of the recording heads 17*a* to 17*c* and protect the ink ejection surfaces F, and they also prevent leakage and evaporation of ink from the ink ejection nozzles 18 (see FIG. 2) arranged in the nozzle regions R of the ink ejection surfaces F. The cap portions 55 are formed of an elastic material, and each configured, as shown in FIG. 21, which will be described later, by coating a surface of a sponge 55*a* with a sheet 55*b* made of PTFE (polytetrafluoroethylene).

The plate fixing screws 57 fix the support plates 53*a* to 53*d*, with the cap portions 55 in intimate contact with the recording heads 17*a* to 18*c* of the line heads 110 to 11K. The plate fixing screws 57 are arranged one on each of front and rear sides of each of the four support plates 53*a* to 53*d*, and thus a total of eight plate fixing screws 57 are provided.

Figure 20:
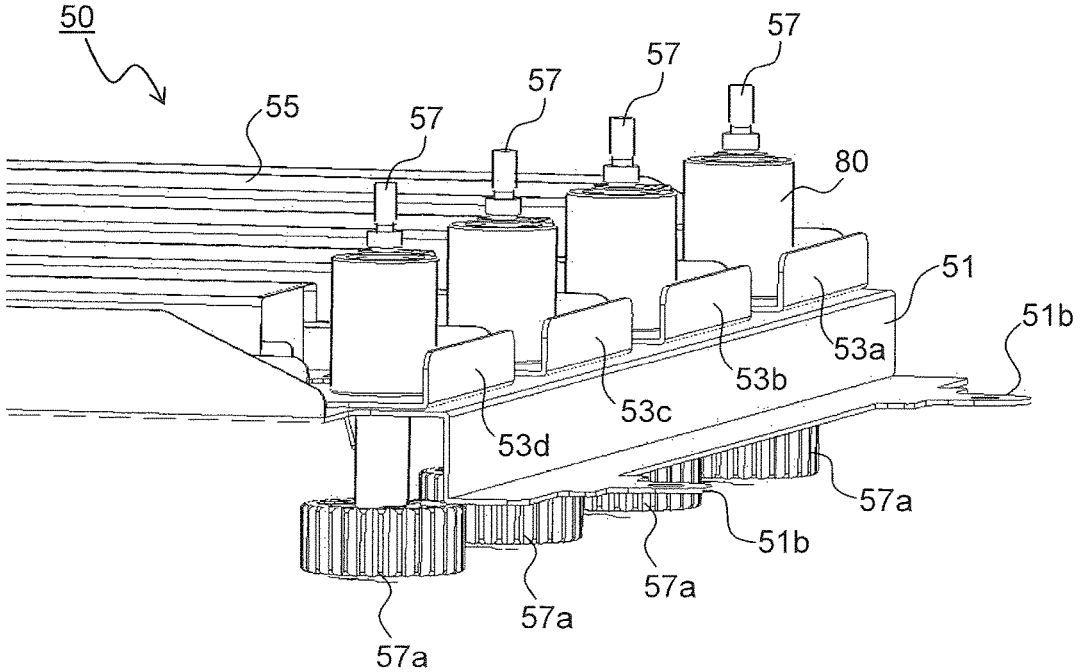
FIG. 20 is a partial perspective view showing a front-side configuration of the transport cap unit according to the embodiment.

FIG. 20 is a partial perspective view showing a front-side configuration of the transport cap unit 50 according to the embodiment. Shaft portions of the plate fixing screws 57 penetrate the unit frame 51 and the support plates 53*a* to 53*d* upward from bottom such that leading end portions thereof project upward from the support plates 53*a* to 53*d*. At lower end portions (head portions) of the plate fixing screws 57, knob portions 57*a* are provided for hand-turning the plate fixing screws 57. The plate fixing screws 57 each have a step portion 57*b* (see FIG. 21) formed in its shaft portion. The plate fixing screws 57 are each formed to have a diameter that is smaller at a leading-end side (in FIG. 21, an upper-side) portion than at a base-end side (in FIG. 21, a lower-side) portion with respect to the step portion 57*b*, and only the leading-end side with respect to the step portion 57*b* penetrates the corresponding one of the support plates 53*a* to 53*d*. When the plate fixing screws 57 are moved up and down, the support plates 53*a* to 53*d* are caught by the step portions 57*b*, as a result of which the support plates 53*a* to 53*d*, together with the plate fixing screws 57, move up and down with respect to the unit frame 51.

Each of the plate fixing screws 57 has a spacer 80 around its shaft portion. When the plate fixing screws 57 are fastened, the spacer 80 prevents the support plates 53*a* to 53*d* from rising above a predetermined position, and maintains the pressure-contact state between the recording heads 17*a* to 17*c* and the cap portions 55 constant. Note that, on the rear side of the transport cap unit 50 as well, four plate fixing screws 57 having the above configuration are arranged one at each of four positions.

Figure 22:
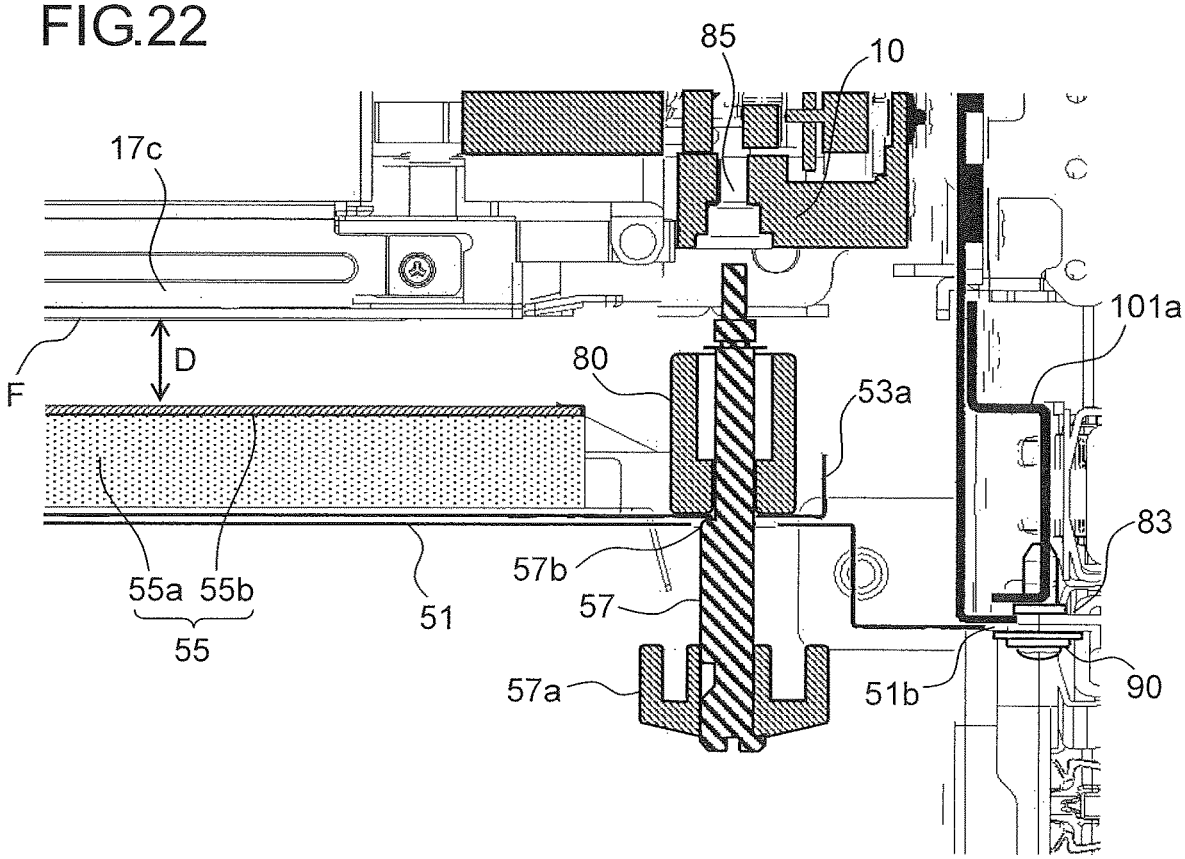
FIG. 22 is a partial sectional view of a front side of the printer, with the transport cap unit according to the embodiment attached to the printer.

Next, a description will be given of how to attach the transport cap unit 50 to the recording heads 17*a* to 17*c* of the printer 100. FIG. 21 and FIG. 22 are partial sectional views of the rear side and the front side, respectively, of the printer 100, and each show a state in which the transport cap unit 50 according to the embodiment is attached to the printer 100. Here, with reference to FIGS. 21 and 22 and later-mentioned FIGS. 24 and 25, a description will be given of an operation of the support plate 53*a*, to which is attached the cap portions 55 corresponding to the recording heads 17*a* to 17*c* of the line head 11C, and the same description applies to the support plates 53*b* to 53*d*, as well.

First, as shown in FIG. 21, the fixing pin 51*a*, which is formed on the rear side of the unit frame 51 of the transport cap unit 50, is inserted in a pin fixing hole 81 formed in a rear-side frame 101*b* of the printer 100.

Next, as shown in FIG. 22, a screw 90 is inserted in one of the screw fastening portions 51*b* from below, the screw fastening portions 51*b* being formed in the front side of the unit frame 51, and the screw 90 is fastened into a screw fixing hole 83 formed in a front-side frame 101*a* of the printer 100. This completes a first stage of attachment procedure for attaching the transport cap unit 50. In this state, the support plate 53*a* is in contact with the upper surface of the unit frame 51, and there is a predetermined clearance D between upper surfaces (sheets 55*b*) of the cap portions 55 and the ink ejection surfaces F of the recording heads 17*a* to 17*c*. The position at which the support plates 53*a* to 53*d* are located with the cap portions 55 and the ink ejection surfaces F apart from each other in this fashion is a first position.

Figure 23:
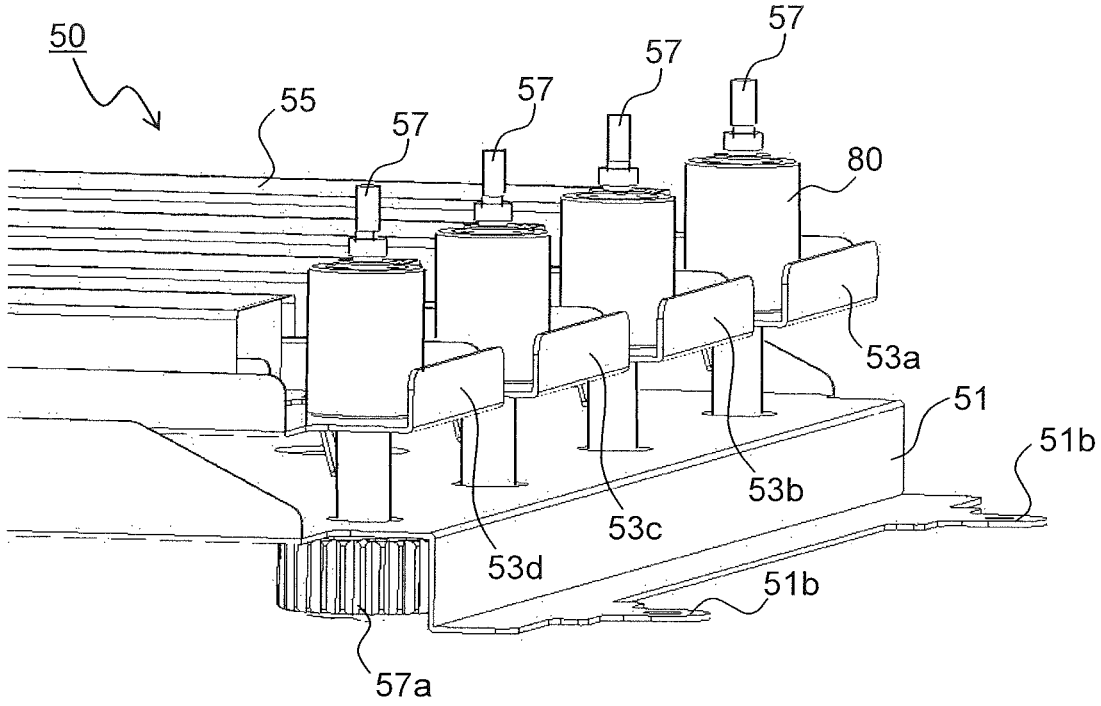
FIG. 23 is a diagram showing a state in which a knob portion of a plate fixing screw has been turned from the state shown in FIG. 20 to raise the support plate.

Next, a second stage of the attachment procedure is executed, in which the cap portions 55 are brought into pressure contact with the ink ejection surfaces F of the recording heads 17*a* to 17*c*. Specifically, by holding and pushing up the knob portions 57*a* of the plate fixing screws 57, as shown in FIG. 23, the support plates 53*a* to 53*d*, together with the plate fixing screws 57, move from the first position upward to be apart from the upper surface of the unit frame 51.

Figure 24:
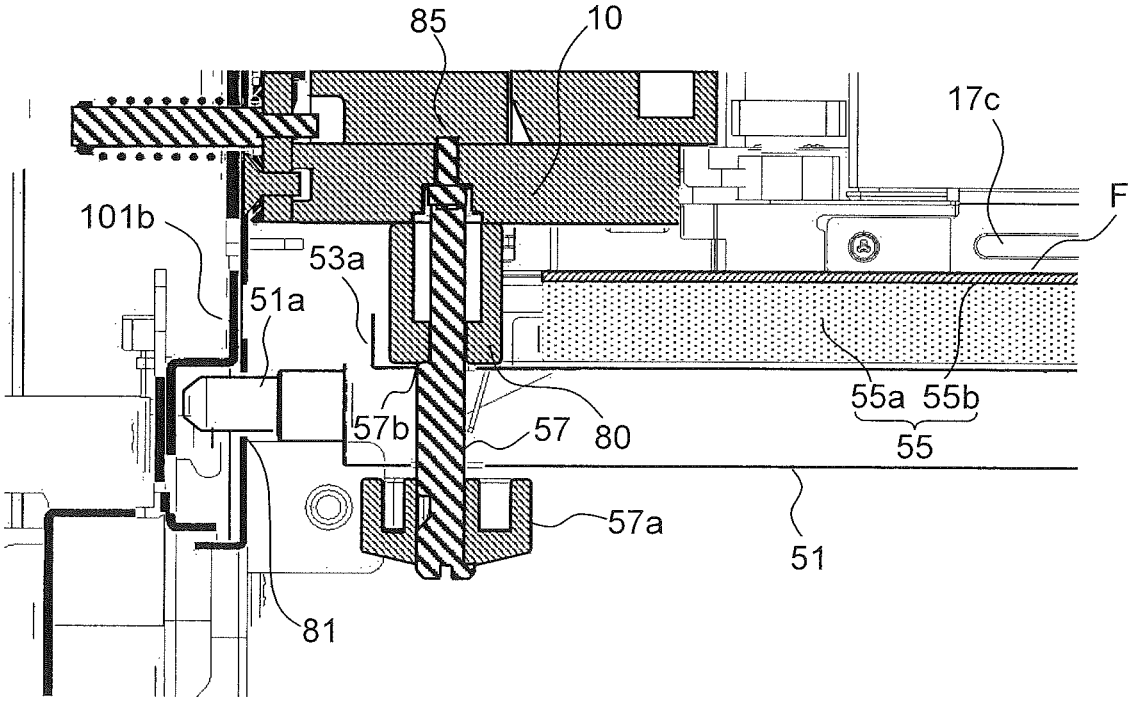
FIG. 24 is a diagram showing a state in which the plate fixing screw has been fastened from the state shown in FIG. 21 such that the support plate is fixed and a cap portion is in intimate contact with the ink ejection surface.
Figure 25:
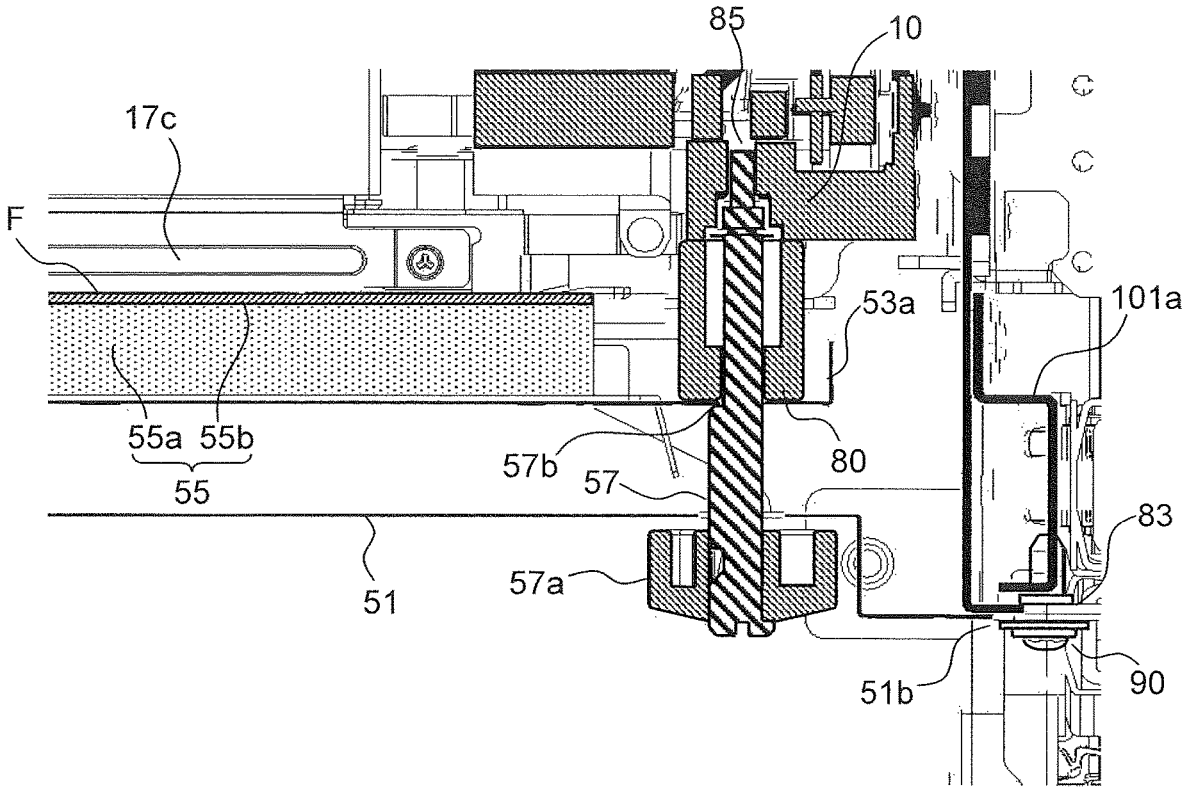
FIG. 25 is a diagram showing a state in which the plate fixing screw has been fastened from the state shown in FIG.

Then, as shown in FIG. 24 and FIG. 25, on the rear side of the transport cap unit 50, the leading end portions of the plate fixing screws 57 are fastened into screw holes 85 formed in the head housing 10. When the plate fixing screws 57 are fastened in the screw holes 85, the spacers 80 around the plate fixing screws 57 come into contact with the head housing 10 to prevent further rising of the support plates 53*a* to 53*d*. At this time, the upper surfaces (the sheets 55*b*) of the cap portions 55 are substantially vertically pressed against the ink ejection surfaces F of the recording heads 17*a* to 17*c* with a predetermined pressure-contact force, whereby the cap portions 55 are brought into intimate contact with the ink ejection surfaces F. The position at which the support plates 53*a* to 53*d* are located with the cap portions 55 and the ink ejection surfaces F contacting each other in this fashion is a second position. The second stage of the attachment procedure is completed in this fashion, and the attaching of the transport cap unit 50 to the printer 100 is completed.

To detach the transport cap unit 50 from the printer 100, the above procedure is performed in a reverse order. First, the plate fixing screws 57 is unfastened from the state shown in FIG. 24 and FIG. 25 to lower the support plates 53*a* to 53*d* from the second position to the first position, to thereby bring about a state in which the upper surfaces (the sheets 55*b*) of the cap portions 55 are apart from the ink ejection surfaces F of the recording heads 17*a* to 17*c* (see FIG. 21, FIG. 22).

Next, the screws 90 having been fastened via the screw fastening portions 51*b* into the screw fixing holes 83 are unfastened to release the front side of the transport cap unit 50 from the fixed state. Lastly, the fixing pins 51*a* are pulled out of the pin fixing holes 81, and the transport cap unit 50 is removed.

According to the transport cap unit 50 having the above configuration, the cap portions 55, which are made of an elastic material, intimately contact the ink ejection surfaces F of the recording heads 17*a* to 17*c*, and this makes it possible to securely protect the ink ejection surfaces F from an external force caused by vibration, shock, or the like during transport.

Further, in the transport cap unit 50 according to the embodiment, unlike in the cap unit 30 used when the printer 100 is in operation, there is no space between the cap portions 55 and the ink ejection surfaces F. Thus, it is possible to prevent leakage of preservation liquid having been filled into the recording heads 17*a* to 17*c* at the time of shipment from the factory.

Further, with the transport cap unit 50 attached to the printer 100, the support plates 53*a* to 53*d* can be moved to the first position and to the second position. Thus, it is possible, after the transport cap unit 50 is attached to the printer 100, to make the support plates 53*a* to 53*d* move from the first position to the second position to substantially vertically bring the cap portions 55 into contact with the ink ejection surfaces F. Further, it is possible to make the support plates 53*a* to 53*d* move from the second position to the first position before detaching the transport cap unit 50 to separate the cap portions 55 substantially vertically from the ink ejection surfaces F. Accordingly, it is possible to securely prevent friction between the ink ejection surfaces F and the cap portions 55 during attachment and detachment of the transport cap unit 50.

The four support plates 53*a* to 53*d* are provided independently one for each of the colors corresponding to the line heads 11C to 11K of the recording portion 9. As a result, in comparison with a configuration where the cap portions 55 for the four colors are all supported by using a single support plate, vibration of the support plates 53*a* to 53*d*, which are each light-weight, is reduced. Moreover, the support plates 53*a* to 53*d* can be raised or lowered with an easier operation.

For replacement of the recording heads 17*a* to 17*c* with new ones, an operation is performed with the power turned off, and thus the transport cap unit 50 is attached in place of the cap unit 30, which is for use when the printer is in operation. At this time, if the cap portions 55 contact the new recording heads 17*a* to 17*c*, the ink ejection surfaces F may be damaged. By providing the support plates 53*a* to 53*d* independently one for each color as in the embodiment, it becomes possible to have the cap portions 55 pressed against such ones of the recording heads 17*a* to 17*c* as are not to be replaced with new ones, while having the cap portions 55 apart from such ones of the recording heads 17*a* to 17*c* as are to be replaced with new ones. Thus, it is possible to prevent damage to the recording heads 17*a* to 17*c* at the time of attachment, and also to prevent drying of such ones of the recording heads 17*a* to 17*c* as are not to be replaced.

Here, in a case where vibration is applied to the printer 100 during transport, there may occur a phase shift between the vibration of the front-side frame 101*a* and the rear-side frame 101*b* and the vibration of the recording heads 17*a* to 17*c*. At this time, if the cap portions 55 are fixed directly to the front-side frame 101*a* or the rear-side frame 101*b* of the printer 100, the ink ejection surfaces F may be rubbed by surfaces of the cap portions 55.

In the transport cap unit 50 of the embodiment, the support plates 53*a* to 53*d* which support the cap portions 55 are fixed, by means of the plate fixing screws 57, to the head housing 10 which holds the recording heads 17*a* to 17*c*. Thereby, even when vibration is generated during transport, no phase shift occurs between the vibration of the recording heads 17*a* to 17*c* and the vibration of the cap portions 55, and thus, it is possible to effectively reduce rubbing between the ink ejection surfaces F and the cap portions 55 during transport.

It should be understood that the present disclosure is not limited to the above embodiments, and various modifications are possible within the scope of the present disclosure. For example, as the unit moving mechanism constituted by the drive motor 72, the gear train, etc., and the unit lift mechanism constituted by the wipe lift motor 76, the gear train, the rotation shaft 75, etc., conventionally known other drive mechanisms may be used.

The number of the ink ejection nozzles 18 and the intervals between the ink ejection nozzles 18 in the recording heads 17*a* to 17*c*, for example, can be appropriately set in accordance with the specifications of the printer 100. Further, the number of the recording heads in each of the line heads 11C to 11K is not limited to three, and, for example, one recording head, two recording heads, or four or more recording heads may be arranged in each of the line heads 11C to 11K.

The present disclosure is usable in a cap unit that protects an ink ejection surface of a recording head. By using the present disclosure, it is possible to provide such a cap unit for a recording head as is capable of reducing leakage of preservation liquid from the recording heads into which the preservation liquid has been filled, and is also capable of reducing rubbing between a recording head and a cap at the time of attaching or detaching the cap or during transport, and an inkjet recording apparatus provided with such a cap unit.

What is claimed is:

1. A cap unit, comprising:

a cap portion which intimately contacts an ink ejection surface of a recording head of an inkjet recording apparatus and protects the ink ejection surface;

a support plate to which the cap portion is fixed;

a unit frame which supports the support plate to be movable in an up-down direction, and which has a fixing mechanism with respect to the inkjet recording apparatus; and a plate moving mechanism which is capable of moving the support plate, with the unit frame fixed to the inkjet recording apparatus, to a first position at which the cap portion is apart from the ink election surface, and to a second position at which the cap portion is in contact with the ink ejection surface, wherein the plate moving mechanism fixes the support plate having moved to the second position and a head housing in which the recording head is held in a state where the support plate engages with the head housing.

2. The cap unit according to claim 1, wherein the support plate includes a plurality of support plates provided one for each color of ink ejected from the recording head, the plurality of support plates being supported to be movable independently of each other in the up-down direction with respect to the unit frame, and the plate moving mechanism is capable of moving each of the plurality of support plates individually to the first position and to the second position.

3. The cap unit according to claim 1, wherein the plate moving mechanism is a plate fixing screw provided at the support plate, by fastening the plate fixing screw into a screw hole formed in the head housing, the support plate is fixed at the second position to be apart from the unit frame, and by releasing fastening between the plate fixing screw and the screw hole, the support plate is held at the first position to be in contact with the unit frame.

4. The cap unit according to claim 3, wherein the plate fixing screw has a restriction member which prevents the support plate from moving upward above the second position.

5. The cap unit according to claim 3, wherein a step portion is formed in a shaft portion of the plate fixing screw such that the plate fixing screw has a diameter that is smaller on a leading-end side than on a base-end side with respect to the step portion, and only such a portion of the shaft portion as is on the leading-end side with respect to the step portion upwardly penetrates the support plate such that the support plate, together with the plate fixing screw, moves up and down with respect to the unit frame.

6. The cap unit according to claim 1, wherein the cap portion is constituted by an elastic body and a fluororesin sheet with which a surface of the elastic body is coated.

7. The cap unit according to claim 1, wherein the fixing mechanism is constituted by a fixing pin which horizontally projects from one end side of the unit frame, and which is inserted in a pin fixing hole in the inkjet recording apparatus, and a screw fastening portion which is provided in another end side of the unit frame, and which is screw-fastened to the inkjet recording apparatus.

8. An inkjet recording apparatus, comprising:

a recording medium conveyance portion which conveys a recording medium;

a recording portion in which the recording head which ejects ink onto the recording medium conveyed by the recording medium conveyance portion is arranged; and the cap unit according to claim 1 which is attached on the ink ejection surface of the recording head arranged in the recording portion.

9. A cap unit, comprising:

a cap portion which intimately contacts an ink ejection surface of a recording head of an inkjet recording apparatus and protects the ink ejection surface;

a support plate to which the cap portion is fixed;

a unit frame which supports the support plate to be movable in an up-down direction, and which has a fixing mechanism with respect to the inkjet recording apparatus; and a plate moving, mechanism which is capable of moving the <support plate, with the unit frame fixed to the inkjet recording apparatus, to a first position at which, the cap portion is apart from the ink ejection surface, and to a second position at which the cap portion is in contact with the ink ejection surface, wherein the fixing mechanism is constituted by a fixing pin which horizontally projects from one end side of the unit frame, and which is inserted in a pin fixing hole in the inkjet recording apparatus, and a screw fastening portion which is provided in another end side of the unit frame, and which is screw-fastened to the inkjet recording apparatus.

10. An inkjet recording apparatus, comprising:

a recording medium conveyance portion which conveys a recording medium;

a recording portion in which the recording head which ejects ink onto the recording medium conveyed by the recording medium conveyance portion is arranged; and the cap unit according to claim 9 which is attached on the ink ejection surface of the recording head, arranged in the recording portion.

* * * * *